United States Patent [19]

Bushee

[11] 3,953,951

[45] May 4, 1976

[54] WOOD PANEL DOOR

[76] Inventor: Harold R. Bushee, 501 Vineyard Road, NE., Albuquerque, N. Mex. 87113

[22] Filed: Sept. 30, 1974

[21] Appl. No.: 510,750

[52] U.S. Cl. ..... 52/457; 52/593; 52/624; 52/656; 52/753 E; 52/753 K; 52/753 T

[51] Int. Cl.[2] ..... E06B 3/70; E06B 3/74

[58] Field of Search ..... 52/455, 457, 458, 586, 52/593, 615, 624, 753 E, 753 K, 753 T, 753 D; 161/17; 49/501

[56] References Cited

UNITED STATES PATENTS

| | | | |
|---|---|---|---|
| 247,349 | 9/1881 | Hill | 52/457 |
| 1,568,395 | 1/1926 | Biles | 52/624 |
| 1,635,466 | 7/1927 | De Penning | 52/624 |
| 2,334,113 | 11/1943 | Malarkey | 52/455 |
| 3,225,505 | 12/1965 | Lytz | 52/615 |

FOREIGN PATENTS OR APPLICATIONS

| | | | |
|---|---|---|---|
| 245,332 | 1/1926 | United Kingdom | 52/753 E |
| 349,130 | 5/1931 | United Kingdom | 52/593 |
| 960,229 | 3/1957 | Germany | 52/753 T |

*Primary Examiner*—Ernest R. Purser
*Assistant Examiner*—William Randolph
*Attorney, Agent, or Firm*—Richard A. Bachand

[57] ABSTRACT

A door includes at each of its corner junctions between its rail and stile a dowel rod located in a hole extending through the stile and into the rail. The dowel rod is mounted at an angle of approximately 10° from horizontal, with the dowels at the top junctions or joints being oriented inwardly downwardly, and with the dowels at the bottom joints being located inwardly upwardly.

A center panel is carried within the rectangular frame defined by the stiles and rails, and is mounted therein by four splines, each located in corresponding grooves along the edge of the center panel and along the interior of the stiles and rails. The splines are not glued or affixed to the center panel or to the stiles or rails, and are arranged at their corners to overlap by virtue of a split lap joint, thereby making the seam between the center panel and the rails and stiles essentially airtight.

A plurality of boards forming the center panel each includes at each edge thereof a parallel tongue and groove, to mate with a parallel tongue and groove corresponding thereto on the adjacent board, thereby providing an airtight seal allowing a considerable amount of expansion or shrinkage of any board of the panel.

2 Claims, 6 Drawing Figures

WOOD PANEL DOOR

BACKGROUND OF THE INVENTION

1. Field of the Invention

This invention relates to improvements in doors, and more particularly, to improvements in corner joints, panel mounting, and center panel board mountings of doors.

2. Description of the Prior Art

In the manufacture of doors, particularly of doors of relatively heavy materials, such as of solid wood construction, one of the design problems most frequently encountered is in providing means for counteracting the forces of the weight of the door upon the elements forming the door. For example, typically in a door having a pair of parallel rails connected at their ends by a pair of parallel stiles, when the door is hung upon one of the stiles, for example, the weight of the other stile and of the rails presents a moment at the interconnection between the hinged stile and the top and bottom rails tending to allow the rails to rotate downwardly and away from the hinged stile. Likewise, the non-hinged stile will tend to separate from the rails by virtue of similar moments acting at their joints.

In attempts to overcome this separation tendency, one or more, and typically three, pins or rods are located at the rail-stile junction, partially extending into the rail and partially extending into the stile. Although the pins have been successful to some extent in lighter doors, in heavier doors, they lend insufficient strength to the door to withstand the weight which the elements of the door present.

In the manufacture of doors, one of the designs which has been found to be particularly attractive and of widespread favor is that in which the center panel, i.e., the panel inserted within the rectangular area defined by the rails and stiles, is of a plurality of parallel boards. The boards are mounted edge to edge, and fastened at the outer edges thereof to the rails and stiles. In this door design, the weight of the solid boards of the center panel compound the weight problem above mentioned. Additionally, numerous other problems are presented by the multiple board panel, for example, the mounting of the panel to the rails and stiles presents a significant problem in that an airtight interface between the boards of the panel and the rails or stiles to which they are adjacently mounted, although necessary, is difficult to achieve. If the boards are merely nailed and/or glued in place, the shrinkage or expansion of one or more of the boards may destroy the airtight seal, if not the entire center panel door frame connection. Additionally, the airtight requirement of the door is difficult to achieve because of the interconnections between adjacent boards making up the center panel. Thus, for example, if a common tongue and groove connection is made between adjacent boards, the shrinkage of one board to an extent approximately equal to the width of the tongue would destroy the airtight seal between the adjacent boards.

Typical tongue and groove connections, known in the art, are generally such that a single groove is provided centrally along the length of one of the boards to be connected. A mating tongue is presented running along the length of the other board to be mounted. The two boards are interconnected by mating the tongue and groove of the respective boards and subsequently affixing the boards in the mating position by glue, nails or other such fastening means.

However, another problem encountered in the mounting of the number of boards edge to edge is the warping which can take place by one or more of the boards. Ordinarily, if the door is exposed to different environmental conditions on either side, for example, temperature, humidity, and so forth, the boards of the door naturally tend to warp in one direction or the other, depending on the orientation of the grain of the boards. This problem is compounded in the mounting of one board upon another by the common tongue and groove method, as described above. For example, the orientation of one board upon another is dependent principally upon the manner in which the tongue and groove of the boards if formed. Once the tongue and groove are formed in any particular board, its orientation in the final panel is fixed. It cannot be turned in either direction, as would be desirable. Thus, the resulting center panel may include adjacent boards having haphazardly oriented grain patterns, which are randomly oriented depending upon the manner in which the tongue and grooves are formed in the individual boards.

SUMMARY OF THE INVENTION

In light of the above, therefore, it is an object of the invention to provide a means for connecting the rails and stiles of a door at its corners to prevent the door from pulling apart and to enable the door to be made of relatively heavy material.

It is another object of the invention to provide a means for minimizing warping effects of the wood within the door upon the door itself.

It is another object of the invention to provide an airtight means for mounting a center panel within a rectangle defined by the rails and stiles of the door.

It is still another object of the invention to provide a means for mounting a number of boards edge-to-edge to form a single panel whereby the grain can be oriented in alternating opposite directions to minimize warping of the panel.

It is still another object of the invention to provide an improved door having strength and airtight properties including a large number of constituent design parts.

These and other objects, features and advantages will become apparent to those skilled in the art from the following detailed description when read in conjunction with the appended claims and accompanying drawings.

The invention, in its broad aspect, presents a door which includes a pair of parallel rails. A pair of parallel stiles are joined at their ends to the ends of the rails to form a rectangle. A center portion or member is carried within the rectangle upon the rails and stiles. Four rods are mounted, one at a respective joint between the stiles and rails, within a hole extending through the stile and into the rail. Two of the four rods are mounted at the top joints at an angle of approximately 10° from horizontal, sloping inwardly downwardly, and two of the four rods are mounted at the bottom joints at an angle of approximately 10° from horizontal, sloping inwardly upwardly.

In another broad aspect of the invention, a door is presented which includes a center member located within the rectangle formed by the rails and stiles. Four splines are provided, each being located within a groove in a respective edge of the center member and a corresponding groove of one of the stiles or rails to carry the center member upon the rails and stiles.

In still another broad aspect of the invention, a door is presented in which the center member is formed of a plurality of parallel boards carried edge-to-edge upon the rails and stiles within the rectangle formed by the rail and stile frame. Each of the boards forming the center member has a parallel tongue and groove formed along its length on each side adjacent to an edge of an adjacent board to mate with a corresponding tongue and a corresponding groove on the adjacent board, each of the boards forming the center member being disposed with the grain thereof opening in alternating opposite facing directions.

Finally, in its broad aspect, a door utilizing the corner braces, the center member mounting splines, and the tongues and grooves formed on the center member boards is presented in overall combination.

BRIEF DESCRIPTION OF THE DRAWING

The invention is illustrated in the accompanying drawing, wherein.

In the figures of the drawing, like reference numerals are used to denote like parts. Additionally, it should be pointed out that various sizes and dimensions of the parts of the door have exaggerated or distored for clarity of illustration and ease of description.

DETAILED DESCRIPTION OF THE PREFERRED EMBODIMENTS

Figure 1:
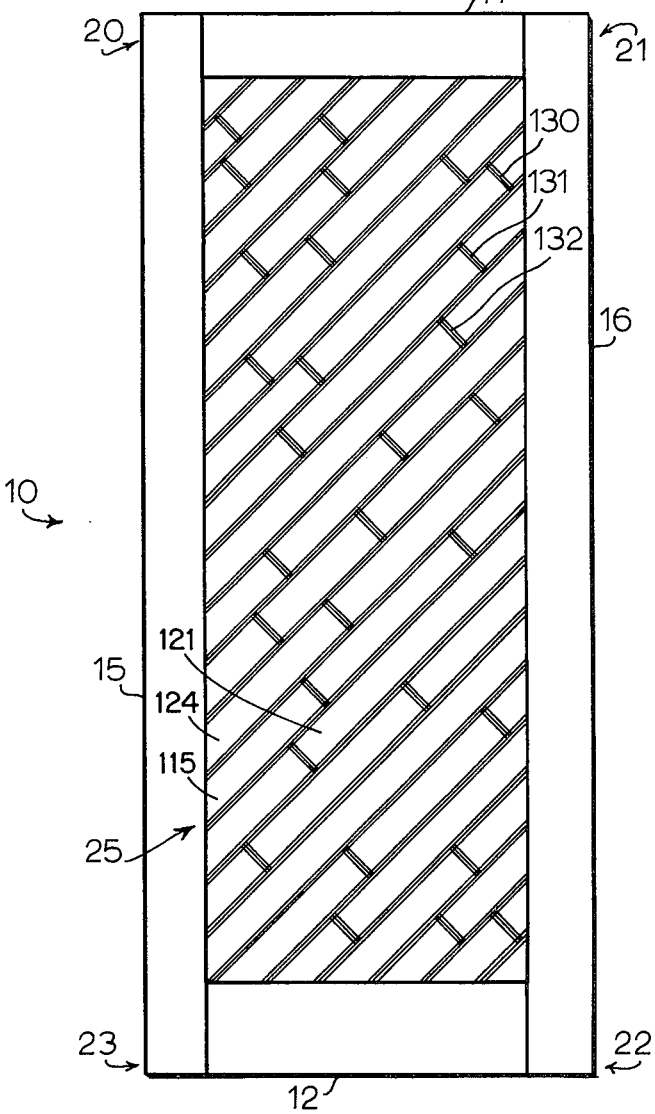
FIG. 1 is a front elevation of a door, fabricated in accordance with the principles of the invention, showing one manner of orienting the boards of the center panel.
Figure 2:
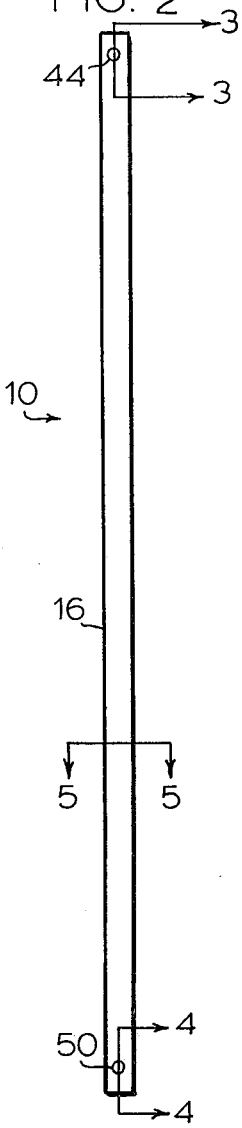
FIG. 2 is a side elevation of the door of FIG. 1.

An elevational view of a door 10 in accordance with a preferred embodiment of the invention is shown in FIG. 1. The door has a top rail 11 and a parallel bottom rail 12. Likewise, it has a left stile 15 and a right stile 16 which are attached at their ends to the ends of the rails 11 and 12 to form the corner joints 20, 21, 22 and 23. The rails 11 and 12 and stiles 15 and 16 form a frame defining an interior rectangle which receives a center panel, indicated generally by the reference numeral 25. As can be seen, the center panel is formed of a number of boards disposed edge-to-edge, one upon the other. In the embodiment shown in FIG. 1, the boards are oriented diagonally, sloping upwardly from left to right. Additionally, in most of the board lengths, at least two boards are utilized. The connections between adjacent boards upon their edges and at their ends is described below in detail.

Figure 6:
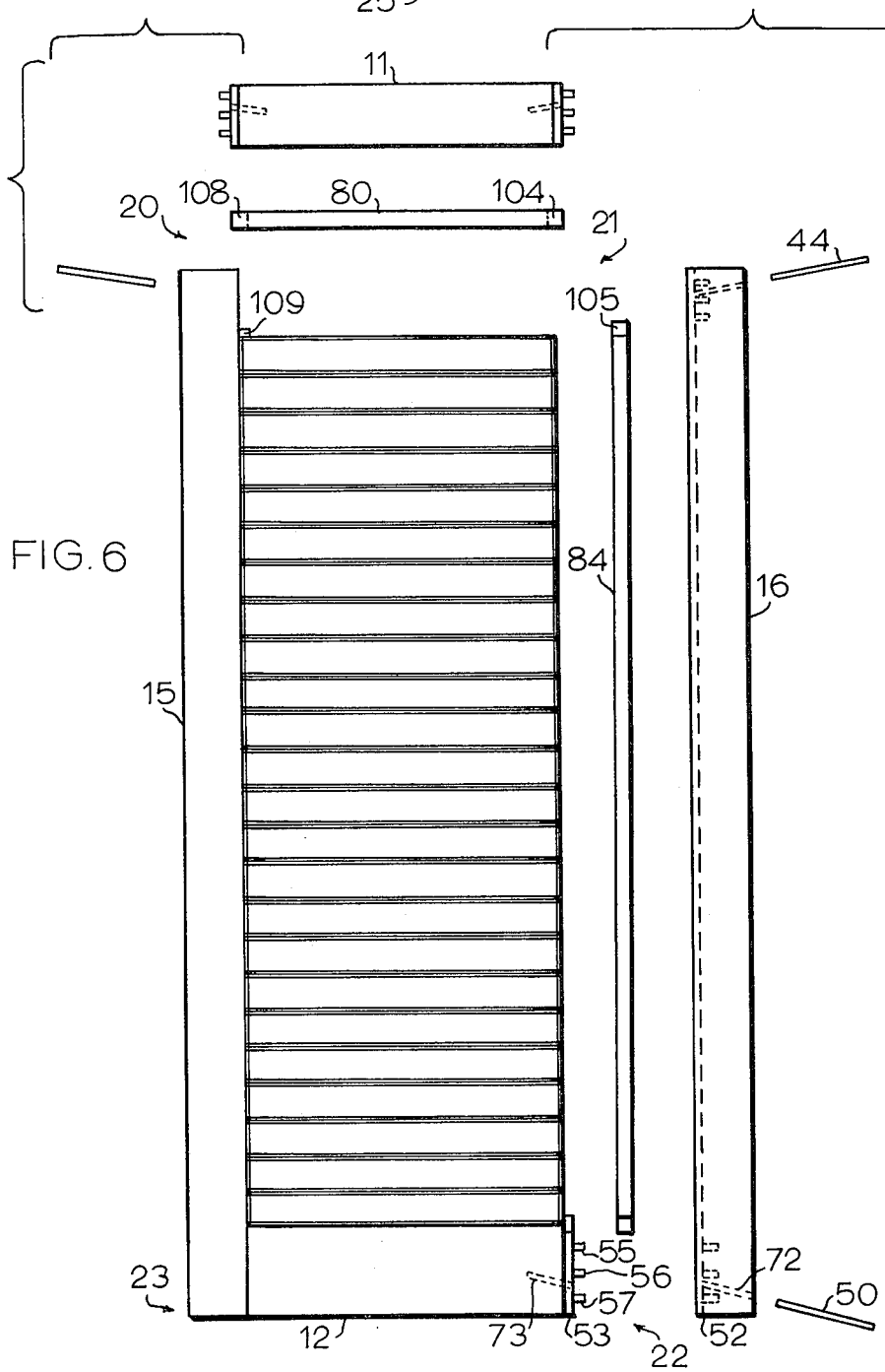
FIG. 6 is an exploded elevational view of a door, fabricated in accordance with the principles of the invention, showing an alternative embodiment of the boards of the panel in horizontal orientation.

It should be noted that other board arrangements can be employed in the fabrication of the center panel 25. For example, the boards can be arranged completely vertically, horizontally (as shown in FIG. 6), or with a portion diagonally upward and another portion diagonally downward.

Figure 3:
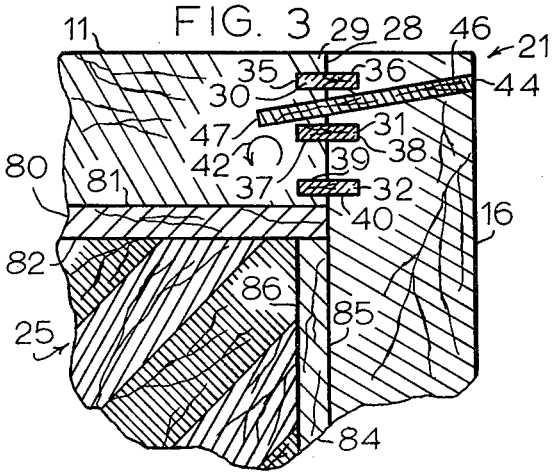
FIG. 3 is a cross-sectional view of an upper corner of the door of FIG. 1, taken at 3—3 in FIG. 2.

The corners 20–23 of the door 10 are fastened in a manner to be enabled to support the weight of the door after it has been hung. The corner 21 between the rail 11 and the stile 16 is shown in the cross-sectional view of FIG. 3. The basic connection between the rail 11 and the stile 16 is a mortise and tenon joint. The groove or mortise 28 in the stile 16 receives the tongue or tenon 29 of the rail 11, thereby securing the rail 11 and stile 16 against movement in the direction of their faces. At least a pair of, and in the embodiments illustrated, three dowel pins 30, 31 and 32, are located in hole pairs 35–36, 37–38, and 39–40, which extend at corresponding locations between the rail 11 and stile 16 through the region of the mortise 28 and tenon 29. The dowels 30–32 are securely glued in place with a water-resistant glue. The dowels serve to reinforce the door from vertical motion between the parts.

The door frame, however, with reference to the upper corner connection between the rail 11 and stile 16, presents a rotational moment in a counterclockwise direction, as shown by the arrow 42, because of the weight of the rails 11 and 12, the stile 15, and the center member or panel 25. Thus, the rail 11 tends to rotate away from the stile 16, despite the inclusion of the dowel pins 30–32, which serve principally to present vertical strength. To overcome this rotational moment, an angularly oriented elongated dowel rod 44 is employed. The dowel rod 44 is located in a hole or channel 46 extending entirely through the width of the stile 16 and into a correspondingly located hole 47 extending a distance into the rail 11. The holes 46 and 47 are centrally located to traverse the mortise 28 and tenon 29 between the smaller horizontally oriented dowel pins 30 and 31.

The elongated dowel rod 44 is oriented at an angle of approximately 10° from horizontal, sloping inwardly downwardly, as shown. The elongated dowel rod 44, therefore, tends to oppose the separation of the rail 11 and stile 16 caused by a moment as diagrammatically shown by the arrow 42.

Figure 4:
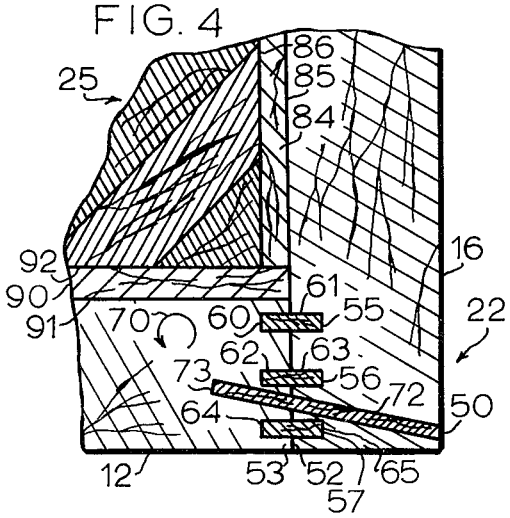
FIG. 4 is a cross-sectional view of a lower corner of the door of FIG. 1, taken at 4—4 in FIG. 2.

The lower corner joint 22 between the rail 12 and stile 16 is shown in FIG. 4. The joint is fabricated in a fashion similar to the joint 21 above-described with reference to FIG. 3, but the elongated dowel 50 at the lower joint 22 is oriented sloping inwardly upwardly, as shown. More specifically, the joint 22 is fabricated about a mortise and tenon connection between the rail 12 and stile 16. Thus, the stile 16 includes a groove or mortise 52 into which a tenon 53 of the rail 12 extends. Three small horizontal dowel pins 55, 56 and 57, are located across the mortise and tenon joint within respective corresponding hole pairs 60–61, 62–63, and 64–65.

Again, because of the weight of the upper rail 11, the lower rail 12, and the opposite stile 15, as well as the weight of the center panel 25, a rotational moment, designated by the arrow 70, is present at the joint 22, tending to separate the rail 12 from the stile 16. To counteract the moment 70, the elongated dowel pin 50 is installed in a hole 72 extending through the width of the stile 16 into a correspondingly located hole 73 extending into the rail 12. Because the elongated dowel rod 50 is oriented approximately 10° sloping inwardly upwardly, as shown, it tends to resist the moment 70 at the joint 22, through the mortise and tenon 52 and 53.

Similar small dowel pins, such as the upper pins 30–32 and the lower pins 55–57, horizontally oriented are located within the joints 20 and 23 on the opposite sides of the door through corresponding mortise and tenon joints thereat (not shown). Similarly, elongated dowel rods are included extending across the width of the stile 15 and into the respective rails 11 and 12. The elongated dowel rod at the upper joint 20 is also oriented sloping inwardly downwardly, in a fashion similar to that shown in the upper corner or joint 21 in FIG. 3, and the lower elongated dowel rod of joint 23 is oriented sloping inwardly upwardly, in a fashion similar to that of the elongated dowel 50 at the joint 22, as shown in FIG. 4. Thus, regardless of which stile, 15 or 16, upon which the door is hung, the rotational moments presented at the corners 21 and 22 or 20 and 23 will be resisted by the elongated dowels 44 and 50 or the dowel rods at the opposite corners 20 and 23 (not shown).

With the door frame thus defined by the upper and lower rails 11 and 12 and the left and right stiles 15 and 16, an interior rectangular shaped area is defined to receive the center panel 25. The center panel 25 can include a number of individual boards aligned edge to edge, as shown, and as below described in detail. The interconnected boards of the center panel 25 are attached to the rails 11 and 12 and stiles 15 and 16 by four splines, one located at or along each edge and received in a groove circumnavigating the edge of the center panel 25, and a corresponding groove in the correspondingly located rail or stile.

The location of the panel securing splines can be seen in FIGS. 3–6. As shown particularly in FIG. 3, an upper spline 80 is located partially within a groove 81 along the length of the upper rail 11, and another groove 82 along the top edge of the panel 25. In a similar fashion, a spline 84 is located within a groove 85 partially within the stile 16 and partially within a groove 86 in the center member 25.

As can be seen in FIG. 4, a spline 90 is located within a groove with a portion 91 within the rail 12 and a portion 92 within the center member 25.

Figure 5:
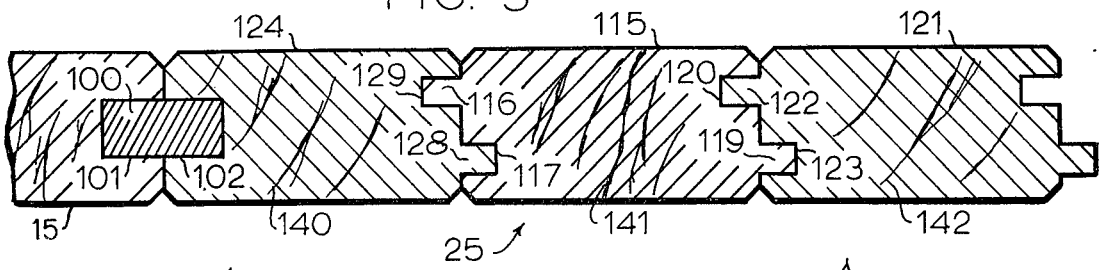
FIG. 5 is a cross-sectional view of a portion of the door of FIG. 1, taken at 5—5 in FIG. 2.

Finally, as can be seen from FIG. 5, a fourth spline 100 is located within a groove having a portion 101 in the stile 15 and another portion 102 located within the center member.

The splines 80, 84, 90, and 100 completely encircle the center member 25. They are each joined at their ends to the adjacent spline by a split lap joint. As can be seen particularly in FIG. 6, a portion 104 is removed from one end of the spline 80, and a portion 105 is removed from an end of the adjacent spline 84. Thus, in place, the removed portions 104 and 105 interfit to present a continuous spline connection about the corner at which they meet. Similarly, a portion 108 is removed from the opposite end of the spline 80, and a corresponding portion 109 is removed from an end of the spline 100 to make continuous connection at the junction between the splines 80 and 100. It should be noted that the splines 80, 84, 90 and 100 are not glued or otherwise attached to the center member 25 or any of the rails 11 or 12 or stiles 15 and 16. Nevertheless, because the splines interfit within their respective grooves in the rails, stiles and center member, and because of the split lap joints at the ends of the splines, the mounting support for the center panel 25 is completely airtight or weathertight. One reason for not glueing or fastening the splines within their respective grooves is to permit natural expansions or contractions of the wood materials without causing splitting or cracking of the wood which would destroy the desired weathertight attributes.

It should also be noted that the manner in which the door is fabricated to permit the insertion of the splines 80, 84, 90 and 100 is shown with reference to the drawing of FIG. 6. In the fabrication of the door, the left stile 15 and lower rail 12 are attached at the corner 23. The manner of attachment, as can be seen from the exploded portion of the corner 22, is essentially in inserting the horizontal pins 55–57 into the corresponding holes of the tenon 53. The stile is then inserted to receive the tenon 53 within the mortise 52, and the pins 55–57. Finally, the elongated dowel rod 50 is inserted into the channel 72 and 73 to complete the joint.

The center panel is first located upon the left stile 15 and bottom rail 12 with the splines 100 and 90 located at the left and bottom interfaces, respectively. The joint at the corner 23 is made in a fashion similar to the joint at the corner 22, above described. The top spline 80 is then implaced, and the top rail 11 inserted to form the upper left hand corner 20, in a fashion similar to that above described with reference to the fabrication of the lower right hand corner 22. The right hand spline 84 is then implaced, and the right hand stile 16 is located and fastened at the corners 21 and 22.

In the fabrication of the center panel 25, as above mentioned, a plurality of individual boards are located edge-to-edge in the desired panel configuration. As above mentioned, panel 25 can be of many different desired designs, such as the diagonal design of the panel 25 in FIG. 1, or of the horizontal design shown in FIG. 6. Regardless of the design, the outside frame formed by the rails 11 and 12 and stiles 15 and 16, and the implacement with the splines 80, 84, 90 and 100 remain the same. Additionally, the mounting of the individual boards one upon the other edge remains essentially the same.

In mounting the boards in the edge-to-edge relationship in the formation of the panel 25, as shown particularly with reference to FIG. 5, each board is provided at each edge to be joined with a parallel tongue and groove. Thus, for example, the board 115 includes a tongue 116 and groove 117 at one edge and a tongue 119 and groove 120 at the other edge. The adjacent board 121 likewise presents a tongue 122 and groove 123 to receive the tongue 119 and to be inserted within the groove 120 of the board 115, respectively. In the board 124, a tongue 128 and groove 129 are formed to respectively receive the tongue 116 and to be inserted into the groove 117 of the board 115. This tongue-groove combination is carried forward in all of the edge connections of the boards forming the members of the panel 25. Additionally, if, as shown in the embodiment of FIG. 1, board end connections are to be made, such as the connections 130, 131, 132 and so forth, a similar tongue-groove pair on each board at each end to be joined can be effected.

The use of the tongue-groove edge of the boards forming the panel are manifold. For example, it has been found that if the grain of each adjacent board is arranged to alternate, or open in alternating opposite directions, any warpage of one board will be essentially cancelled or counteracted by warping in opposite directions of an adjacent board. Thus, by virtue of the double or tongue-groove arrangement, each board can be reversed in the manner similar to that shown in FIG. 5, with the grain 140 of the board 124 opening upwardly, the grain 141 of the board 115 opening downwardly, and the grain 142 of the board 121 opening upwardly, and so forth. Thus, in the formation of the grooves upon the edges of the boards to be subsequently used in the fabrication of the center panel 25, no particular precautions need to be taken to determine the direction which the grain opens. This is in contradistinction to the use of a single tongue which interfits a single groove in an adjacent board, in which the boards are not reversable, and particular attention must be paid to the direction in which the grain opens in the formation of the tongue or groove of the board, particularly when end connections are made as in the embodiment of FIG. 1.

Another advantage realized by use of the tongue-groove of the boards is that in the fabrication of the tongue-groove, the height of the tongue or the dimensions of the tongue can be made essentially the same as the dimensions of a single tongue if that method were chosen. Likewise, the depth of the groove must be sufficient to receive the tongue. Therefore, if one of the boards, for example, board 115, were to shrink because of drying or other reasons, the distance that it would have to shrink would be twice that which ordinarily would be required of a single tongue-groove, before it began to leak air, or became unairtight.

Although the invention has been described and illustrated with a certain degree of particularity, it is understood that the present disclosure has been made only by way of example, and that numerous changes in the details of construction and the combination and arrangement of parts may be resorted to without departing from the spirit and scope of the invention as hereinafter claimed.

I claim:

1. A door, comprising;

a pair of spaced parallel stiles, each having a mortise along an inside edge;

a pair of spaced parallel rails, each having at each end thereof a tenon to form a joint at a mortise adjacent an end of a respective stile, said rails having a mortise along an inside edge;

said pair of stiles and pair of rails joined at the corners to form a rectangle;

at least two horizontal rods at each of said joints, each located within a respective hole extending between said rail and said stile;

four elongated dowel rods, one located at each of said joints within a hole extending the entire width of said stile and into said rail, said elongated dowel rods which are located at the junctions at the bottom of the door being at an angle of approximately ten degrees from horizontal inwardly upwardly, and said two dowel rods which are located at the top joint being at an angle of approximately 10° from horizontal in a direction inwardly downwardly;

a center panel located within said rectangle, carried upon said rails and stiles;

said center panel comprising a plurality of boards arranged edge to edge, each board edge adjacent to another board edge comprising both a tongue and a groove parallel thereto to mate with the tongue and groove of the adjacent board, the grain structure of each of said boards being oriented with the grain opening in alternating facing directions of said panel to minimize warping of said panel;

said panel including a mortise formed around its border to align with the mortise formed within said stiles and said rails;

and four splines, each located within a respective mortise of said center panel and said rails and stiles to retain said center member within said rectangle.

2. The door of claim 1 wherein each of said splines are joined to another of said splines at their ends by a split lap joint, and wherein each of said splines is unaffixed to said other splines, panel, rails and stiles.

* * * * *